US010112404B2

(12) United States Patent
Weaver et al.

(10) Patent No.: US 10,112,404 B2
(45) Date of Patent: Oct. 30, 2018

(54) FLUIDIC EJECTION CARTRIDGE WITH MOLDED CERAMIC BODY

(71) Applicant: Funai Electric Co., Ltd., Osaka (JP)

(72) Inventors: Sean Weaver, Lexington, KY (US); Andrew McNees, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 106 days.

(21) Appl. No.: 15/342,365

(22) Filed: Nov. 3, 2016

(65) Prior Publication Data

US 2018/0117921 A1 May 3, 2018

(51) Int. Cl.
*B41J 2/175* (2006.01)

(52) U.S. Cl.
CPC ..... *B41J 2/17553* (2013.01); *B41J 2/1753* (2013.01); *B41J 2/17513* (2013.01)

(58) Field of Classification Search
CPC ..... B41J 2/17503; B41J 2/17513; B41J 2/17553; B41J 2/175; B41J 2/04
USPC ..... 347/84–87, 100
See application file for complete search history.

(56) References Cited

U.S. PATENT DOCUMENTS

| | | | | |
|---|---|---|---|---|
| 5,509,140 | A * | 4/1996 | Koitabashi | B41J 2/17506 347/100 |
| 5,996,844 | A | 12/1999 | Ito | |
| 6,227,663 | B1 * | 5/2001 | Santhanam | B41J 2/17503 347/86 |
| 2003/0071868 | A1 | 4/2003 | Koshikawa et al. | |
| 2010/0220129 | A1 | 9/2010 | Tomlin et al. | |
| 2011/0057997 | A1 | 3/2011 | Takeuchi | |

* cited by examiner

*Primary Examiner* — An Do
(74) *Attorney, Agent, or Firm* — Luedeka Neely Group, P.C.

(57) ABSTRACT

A fluidic ejection cartridge is disclosed. The cartridge includes a cartridge body having an upper portion, a lower portion, at least one sidewall, and a hollow cavity within the cartridge body defining a fluid reservoir. The cartridge also includes a cartridge lid disposed over and sealed to the upper portion of the cartridge body, as well as a cartridge bottom plate disposed under and sealed to the lower portion of the cartridge body. A cartridge nosepiece is disposed under and sealed to the cartridge bottom plate. This nosepiece includes at least one fluidic ejection chip in fluid flow communication with the fluid reservoir. According to the present disclosure, the cartridge body, the cartridge lid, and the cartridge bottom are each made from ceramic.

16 Claims, 6 Drawing Sheets

FLUIDIC EJECTION CARTRIDGE WITH MOLDED CERAMIC BODY

FIELD

This disclosure relates to the field of cartridge systems for fluidic ejection. More particularly, this disclosure relates to a cartridge system for fluidic ejection having a molded ceramic cartridge body.

BACKGROUND

Fluidic ejection cartridges may be used in variety of applications, including for instance inkjet printing applications. In particular, fluidic ejection cartridges are often used to supply ink for consumer-level, drop-on-demand inkjet printing systems, also referred to as thermal or piezoelectric inkjet printing systems. The inks used in such consumer-level printing systems are typically water-based inks, i.e., inks which use water as the solvent in which the ink pigments are dispersed. Such water-based inks are best suited for printing on relatively porous and easily wetted substrates such as paper, but may not be suitable for printing upon other substrates.

In order to provide satisfactory printing upon less porous substrate materials, it is often necessary to utilize inks formulated with an organic solvent, rather than an aqueous-based solvent, in order to decrease drying time and achieve better penetration of and adhesion to the substrate. In the past, the printing of such non-porous substrates using inks formulated with an organic solvent, has at time been carried out using so-called continuous inkjet systems.

However, such inks formulated with an organic solvent have not been satisfactorily used with drop-on-demand inkjet printing systems. The more aggressive solvents used for these inks have been found to penetrate the plastics used in typical consumer inkjet cartridges, causing the cartridge itself to be partially dissolved or otherwise damaged.

Thus, it would be desirable to provide a system for using inks formulated with an organic solvent to supply ink for drop-on-demand (i.e. thermal or piezoelectric) inkjet printing systems. It would also be desirable to provide system for drop-on-demand printing on non-porous substrates using such organic solvent-based inks.

SUMMARY

The above and other needs are met by a fluidic ejection cartridge according to the present disclosure.

In a first aspect, the present disclosure provides a fluidic ejection cartridge. According to one embodiment, the cartridge includes a cartridge body having an upper portion, a lower portion, at least one sidewall, and a hollow cavity within the cartridge body defining a fluid reservoir. The cartridge also includes a cartridge lid disposed over and sealed to the upper portion of the cartridge body, as well as a cartridge bottom plate disposed under and sealed to the lower portion of the cartridge body. A cartridge nosepiece is disposed under and sealed to the cartridge bottom plate. This nosepiece includes at least one fluidic ejection chip in fluid flow communication with the fluid reservoir. According to the present disclosure, the cartridge body, the cartridge lid, and the cartridge bottom are each made from ceramic.

In certain embodiments, the cartridge body, the cartridge lid, and the cartridge bottom are each preferably made from soda-lime glass. In other embodiments, the cartridge body, the cartridge lid, and the cartridge bottom are each preferably made from borosilicate glass.

In certain embodiments, the cartridge body and the cartridge lid are preferably molded together as a unitary ceramic piece. In other embodiments, the cartridge body and the cartridge bottom plate are preferably molded together as a unitary ceramic piece.

In certain embodiments, the ejection cartridge also preferably includes a fluid filter element disposed between the fluid reservoir and the fluidic ejection chip.

In certain embodiments, the ejection cartridge also preferably includes a volume of an ejectable fluid disposed within the fluid reservoir. In some instances, this ejectable fluid preferably includes at least one organic solvent selected from the group consisting of alcohols, acetates, ketones, oils, hydrocarbon solvents, halogenated solvents, and lactones. More preferably, the ejectable fluid includes at least one organic solvent selected from the group consisting of methanol, ethanol, isopropanol, butanol, 1-methoyx-2-propanol, 2-butoxyethanol, ethyl acetate, butyl acetate, acetone, methyl ethyl ketone, methyl isobutyl ketone, benzene, toluene, xylene, hexane, petroleum, chloroform, diodomethane, N-ethyl-2-pyrrolidone, N-methyl-pyrrolidone, and γ-butyrolactone.

In certain embodiments, the ejectable fluid is preferably a printing ink and may include a pigment or dye in addition to a solvent.

In a second aspect, the present disclosure provides a method for printing on a non-porous substrate. According to one embodiment, the method includes a first step of providing a substrate having a printable, non-porous surface. The method also includes a second step of providing a drop-on-demand inkjet printing system including an inkjet cartridge.

This inkjet cartridge includes a cartridge body having an upper portion, a lower portion, at least one sidewall, and a hollow cavity within the cartridge body defining a fluid reservoir. The cartridge also includes a cartridge lid disposed over and sealed to the upper portion of the cartridge body, as well as a cartridge bottom plate disposed under and sealed to the lower portion of the cartridge body. A cartridge nosepiece is disposed under and sealed to the cartridge bottom plate. This nosepiece includes at least one fluidic ejection chip in fluid flow communication with the fluid reservoir. A volume of an ejectable ink is disposed within the fluid reservoir, wherein the ink comprises a pigment or dye and at least one organic solvent selected from the group consisting of alcohols, acetates, ketones, oils, hydrocarbon solvents, halogenated solvents, and lactones. According to the present disclosure, the cartridge body, the cartridge lid, and the cartridge bottom are each made from ceramic.

The method also includes a third step of printing desired indicia on the non-porous surface of the substrate, using the ejectable ink from the drop-on-demand inkjet printing system.

In certain embodiments of the method, the substrate is preferably a material selected from the group consisting of plastics, metals, glass, and plastic-coated paper.

In certain embodiments of the method, the cartridge body, the cartridge lid, and the cartridge bottom are each preferably made from soda-lime glass. In other embodiments of the method, the cartridge body, the cartridge lid, and the cartridge bottom are each preferably made from borosilicate glass.

In certain embodiments of the method, the cartridge body and the cartridge lid are preferably molded together as a unitary ceramic piece. In other embodiments of the method, the cartridge body and the cartridge bottom plate are preferably molded together as a unitary ceramic piece.

In certain embodiments of the method, the ejection cartridge also preferably includes a fluid filter element disposed between the fluid reservoir and the fluidic ejection chip.

In certain embodiments of the method, the ejectable ink preferably includes at least one organic solvent selected from the group consisting of methanol, ethanol, isopropanol, butanol, 1-methoyx-2-propanol, 2-butoxyethanol, ethyl acetate, butyl acetate, acetone, methyl ethyl ketone, methyl isobutyl ketone, benzene, toluene, xylene, hexane, petroleum, chloroform, diodomethane, N-ethyl-2-pyrrolidone, N-methyl-pyrrolidone, and γ-butyrolactone.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

The present disclosure provides a fluidic ejection cartridge, suitable for use with fluid mixtures having an organic, as opposed to aqueous, solvent base. The present disclosure also provides a method for printing on a non-porous substrate, using the ejection cartridge in a drop-on-demand inkjet printing system.

Figure 1:
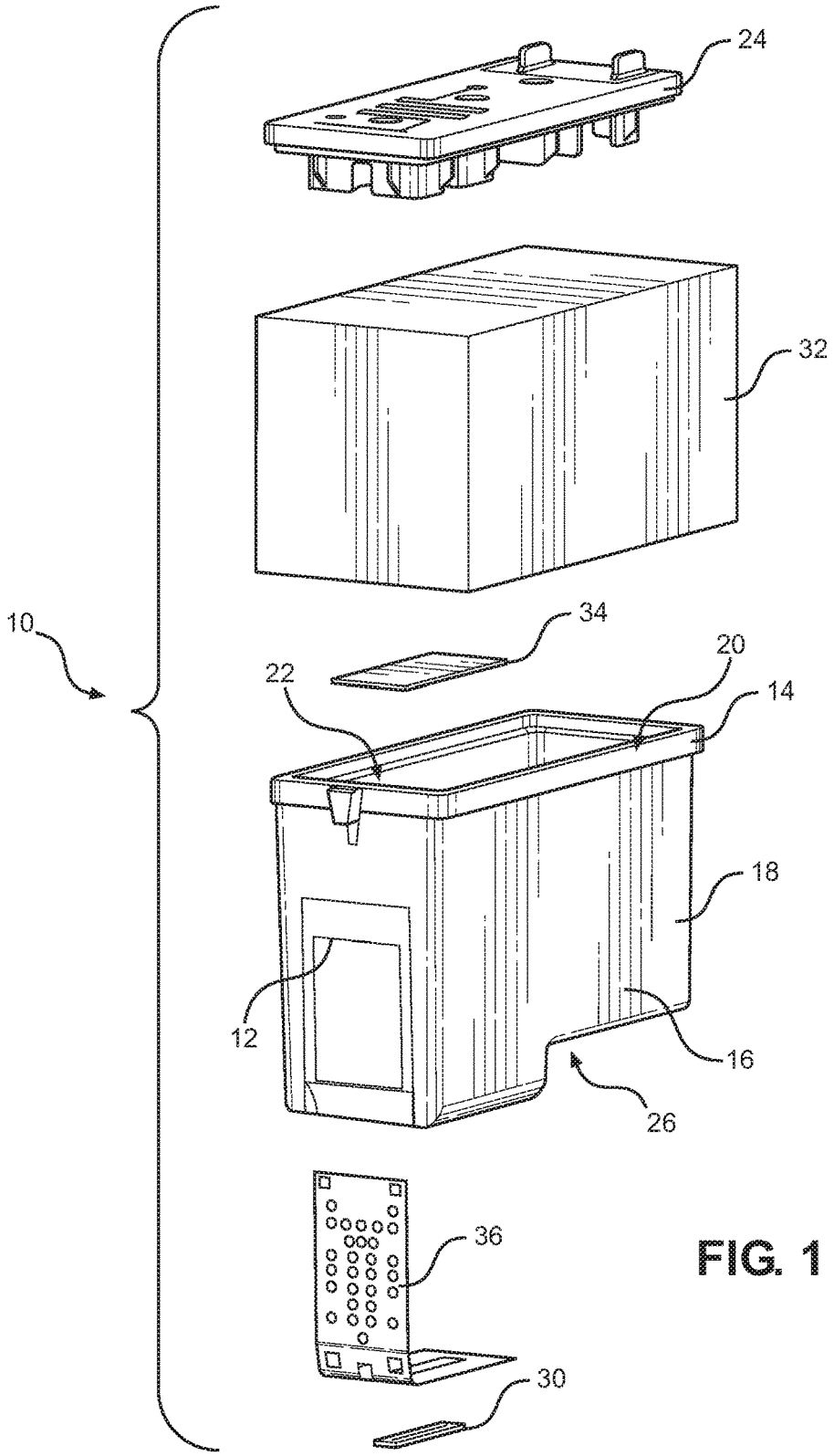
FIG. 1 is an exploded perspective view of a fluidic ejection cartridge.
Figure 2B:
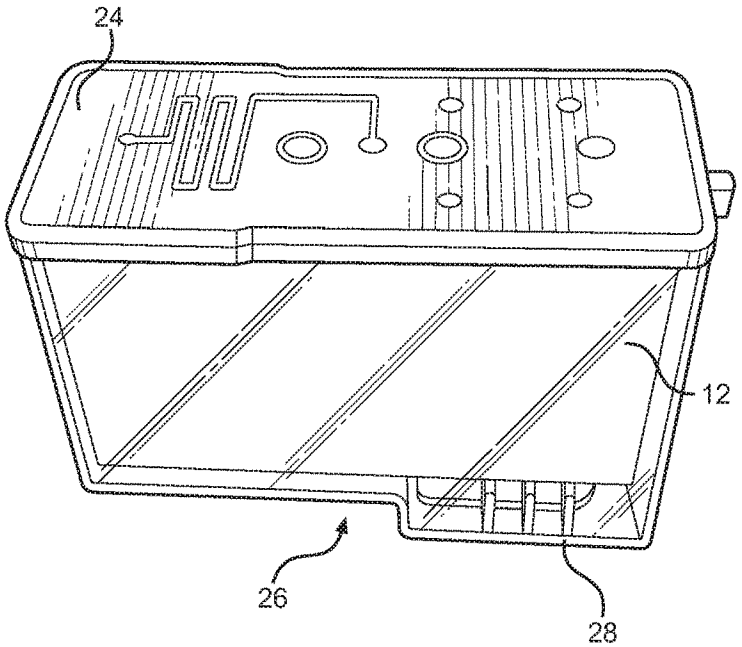
FIGS. 2A & 2B are perspective views of a fluidic ejection cartridge in accordance with one embodiment of the present disclosure.
Figure 2A:
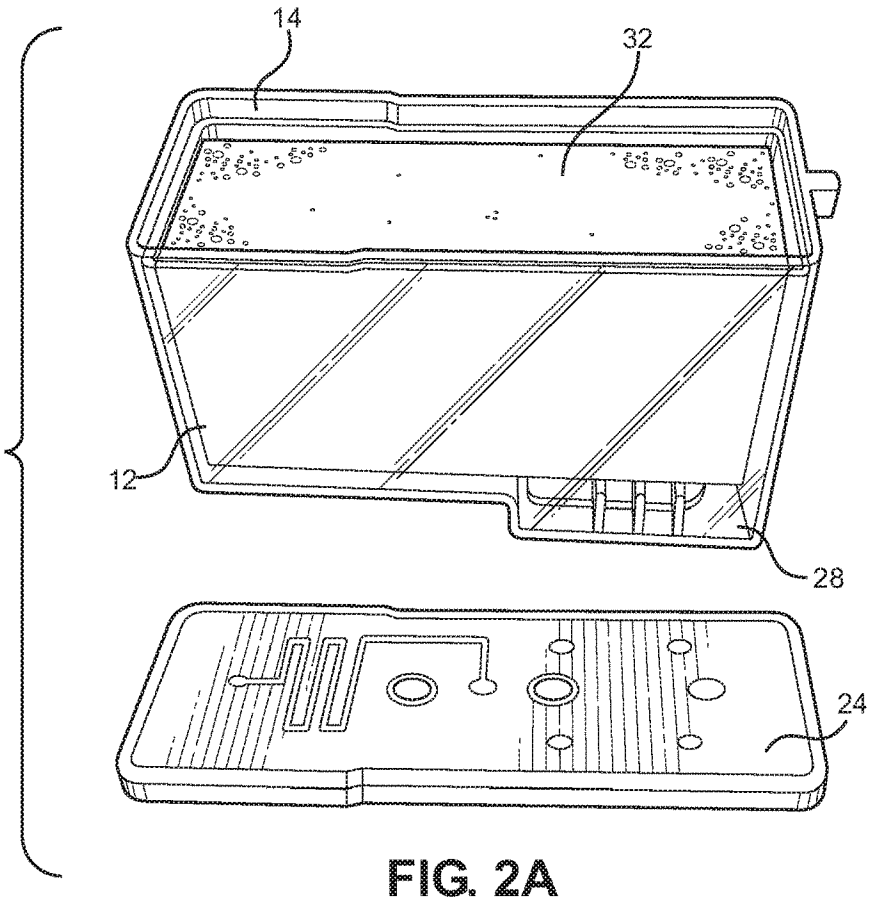

As illustrated in FIG. 1, a fluidic ejection cartridge 10 according to the present disclosure may include a cartridge body 12 having an upper portion 14, a lower portion 16, and at least one sidewall 18. Preferably the cartridge body 12 includes at least four sidewalls. A hollow cavity 20 is formed within the cartridge body 12, which defines a fluid reservoir 22.

The cartridge 10 also includes both a cartridge lid 24 and a cartridge bottom plate 26. The cartridge lid 24 disposed over and sealed to the upper portion 14 of the cartridge body 12. The cartridge bottom plate 26 is disposed under and sealed to the lower portion 16 of the cartridge body 12.

Notably, according to the present disclosure, the cartridge body 12, the cartridge lid 24, and the cartridge bottom plate 26 are each made from a ceramic material. As used herein, ceramics include inorganic materials which may be transparent or opaque, and may be crystalline, partially crystalline, or amorphous in structure. Examples of such ceramics include but are not limited to porcelain and glass materials. In certain embodiments of the present disclosure, the ceramic used for the cartridge body 12, the cartridge lid 24, and/or the cartridge bottom plate 26 may be a glass material. For instance, in some embodiments, the cartridge body 12, the cartridge lid 24, and/or the cartridge bottom plate 26 may be made from soda-lime glass. In other embodiments, the cartridge body 12, the cartridge lid 24, and/or the cartridge bottom may be made from borosilicate glass.

As noted above, the cartridge lid 24 and the cartridge bottom plate 26 are both sealed to the lower portion 16 of the cartridge body 12. The cartridge lid 24 and the cartridge bottom plate 26 may be sealed to the cartridge body 12 using adhesives if desired. Alternatively, either the cartridge lid 24 or the cartridge bottom plate 26 may be sealed to the cartridge body 12 by heating the cartridge body 12 together with the cartridge lid 24 or the cartridge bottom plate 26 to a temperature sufficient to cause the cartridge body 12 to fuse together with either the cartridge lid 24 or the cartridge bottom plate 26.

Figure 3B:
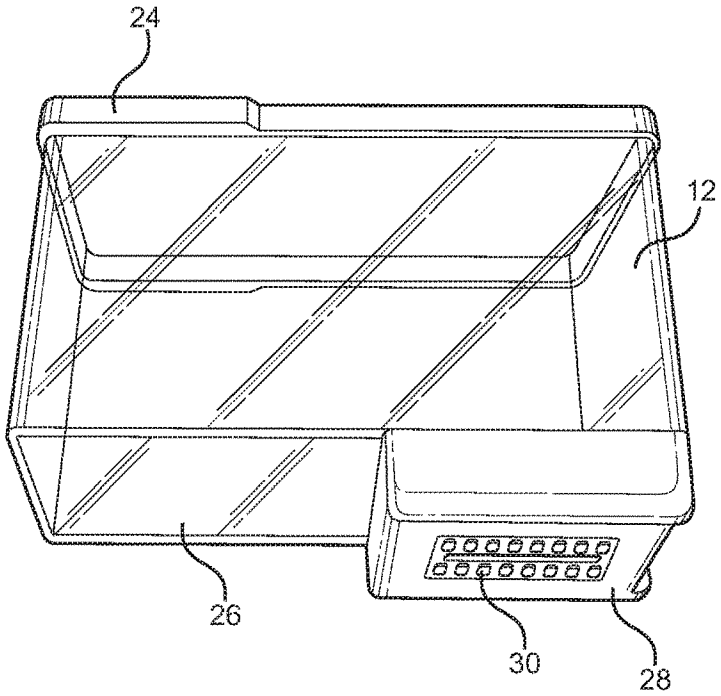
FIGS. 3A & 3B are perspective views of a fluidic ejection cartridge in accordance with one embodiment of the present disclosure.
Figure 3A:
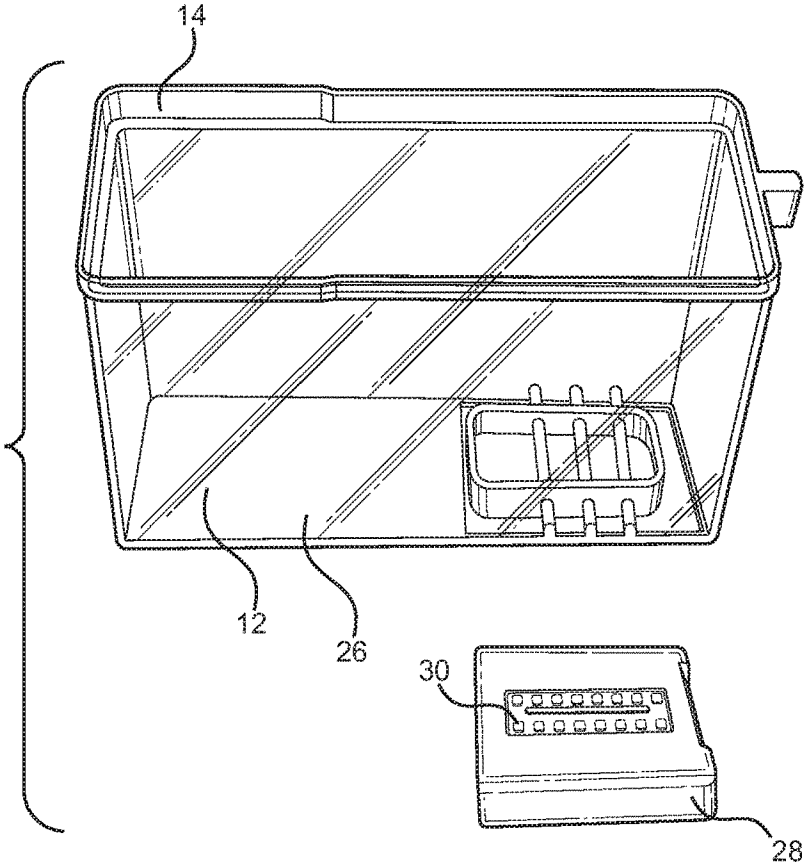
Figure 4B:
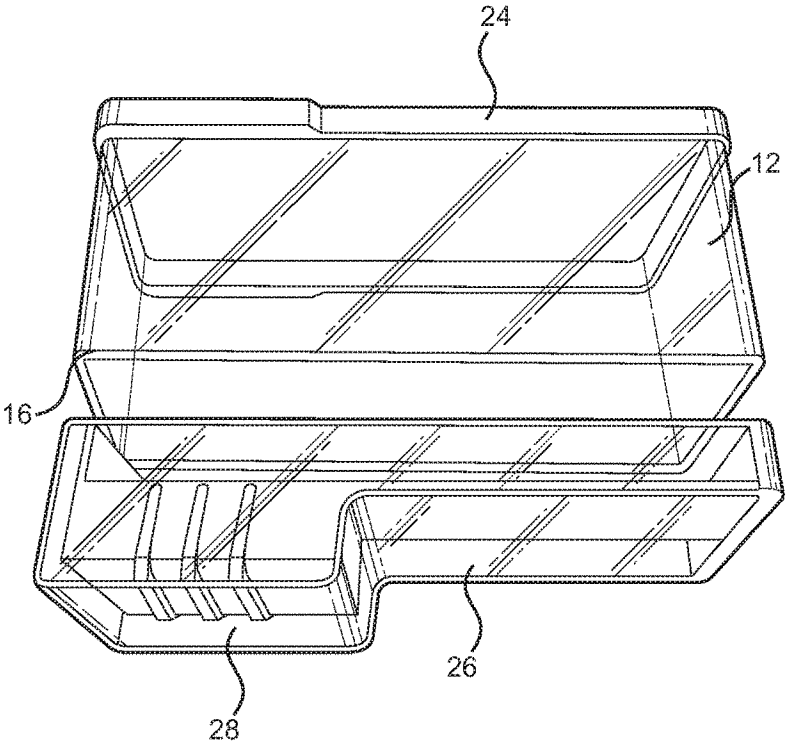
FIGS. 4A & 4B are perspective views of a fluidic ejection cartridge in accordance with one embodiment of the present disclosure.
Figure 4A:
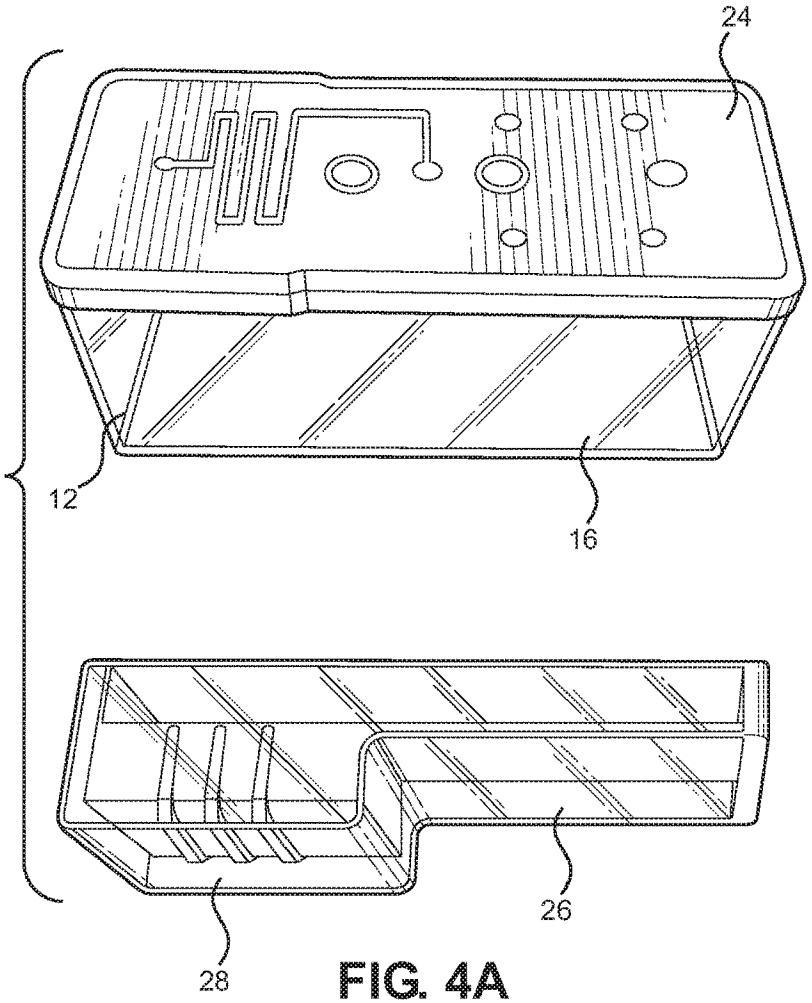

In still other instances, either the cartridge lid 24 or the cartridge bottom plate 26 may be sealed to the cartridge body 12 by molding the cartridge body 12 together with the cartridge lid 24 or the cartridge bottom plate 26 as a single unitary ceramic piece. Thus in one preferred embodiment, the cartridge body 12 and the cartridge bottom plate 26 are preferably molded together as a unitary glass (or other ceramic) piece, as shown in FIGS. 2A, 2B, 3A & 3B. In another preferred embodiment, the cartridge body 12 and the cartridge lid 24 are preferably molded together as a unitary glass (or other ceramic) piece, as shown in FIGS. 4A & 4B.

The cartridge 10 also includes a cartridge nosepiece 28. This nosepiece 28 is disposed under and sealed to the cartridge bottom plate 26. In some instances, the cartridge nosepiece 28 may be sealed to the cartridge bottom plate 26 by molding the cartridge nosepiece 28 and the cartridge bottom plate 26 as a single unitary ceramic piece, as shown in FIGS. 2A, 2B, 4A, & 4B. In other instances, the cartridge nosepiece 28 may be separately formed and sealed to the cartridge bottom plate 26 using adhesives or other suitable means, as shown in FIGS. 3A & 3B.

If integrally molded with the bottom plate 26, the cartridge nosepiece 28 will be formed from the same ceramic material as the bottom plate 26. If the nosepiece 28 is separately formed, however, the nosepiece 28 may be formed from the same or a different glass or ceramic material. The nosepiece 28 may also be formed from metal, or from polymeric materials, as discussed below.

The cartridge nosepiece 28 includes at least one fluidic ejection chip 30 in fluid flow communication with the fluid reservoir 22, via a hole in the bottom plate 26. The ejection chip 30 includes a plurality of nozzles for ejection of a fluid from the cartridge 10. In certain embodiments, the cartridge 10 also preferably includes a foam element 32 disposed within the fluid reservoir 22, as well as a fluid filter element 34 disposed between the fluid reservoir 22 and the fluidic ejection chip 30.

In addition, the cartridge 10 also typically includes a flexible interconnect circuit 36 which is attached to the at least one sidewall 18 and electrically connected to the fluidic ejection chip 30, for providing electronic control of the ejection chip 30.

In general, the ejection cartridge 10 also preferably includes a volume of an ejectable fluid disposed within the fluid reservoir 22. In some instances, this ejectable fluid may be an aqueous based mixture. More typically, however, the ejectable fluid preferably includes at least one organic solvent. For instance, the ejectable fluid may include an organic solvent selected from the group consisting of alcohols, acetates, ketones, oils, hydrocarbon solvents, halogenated solvents, and lactones. More preferably, the ejectable fluid includes at least one organic solvent selected from the group consisting of methanol, ethanol, isopropanol, butanol, 1-methoyx-2-propanol, 2-butoxyethanol, ethyl acetate, butyl acetate, acetone, methyl ethyl ketone, methyl isobutyl ketone, benzene, toluene, xylene, hexane, petroleum, chloroform, diodomethane, N-ethyl-2-pyrrolidone, N-methylpyrrolidone, and γ-butyrolactone.

In certain embodiments, fluidic ejection cartridge 10 may be used as an inkjet printing cartridge. In such instances, the ejectable fluid within the cartridge is a suitable printing ink and typically includes solid pigment particles dispersed within the solvent.

The fluidic ejection cartridge 10 may also be suitably used for other purposes in addition to printing applications. For instance, the fluidic ejection cartridge 10 of the present disclosure may also be used for the controlled fluidic release of fragrances or essential oils, for delivery of drugs in fluidic quantities, or for delivery of fluids in electronic vaping devices.

More preferably, however, the fluidic ejection cartridge 10 of the present disclosure may be used as an inkjet cartridge and incorporated into a drop-on-demand (i.e. thermal or piezoelectric) inkjet printing system. The cartridge 10 may also be used with other dispensing or pumping applications that use thermal or piezoelectric fluid ejection.

In this regard, the fluidic ejection cartridge 10 of the present disclosure is particularly suited for printing on a non-porous substrate. For instance, the cartridge 10 may be used in drop-on-demand printing system to print desired indicia on substrates such as plastics, metals, glass, and plastic-coated paper. Alternatively, the printing system may also be used to print upon more porous substrates, such as uncoated papers.

In the printing of non-porous substrates such as plastics, glass, or metals, the fluidic ejection cartridge 10 is particularly advantageous because the use of ceramic, rather than conventional polymers, in the construction of the cartridge allows for the use of a much wider array of ink solvents. Typically, in conventional inkjet cartridges made from plastic or polymeric materials, it is necessary to use inks which have an aqueous solvent base rather than an organic solvent. If inks having an organic solvent based are used in such inkjet cartridges, the ink solvents have been found to penetrate the plastics used in the cartridges, causing the cartridge partially dissolved or otherwise damaged.

According to the present disclosure, the cartridge body, the cartridge lid, and the cartridge bottom plate are formed from ceramics, such as glass, which are impervious to organic solvents such alcohols, acetates, ketones, oils, hydrocarbon solvents, halogenated solvents, and lactones. Thus, these organics may now be used as solvents in the ink formulation. This is of particular benefit when printing upon non-porous substrates because organic solvent based inks of this type have been found to provide better penetration of and adhesion to the non-porous substrate being printed.

Figure 5A:
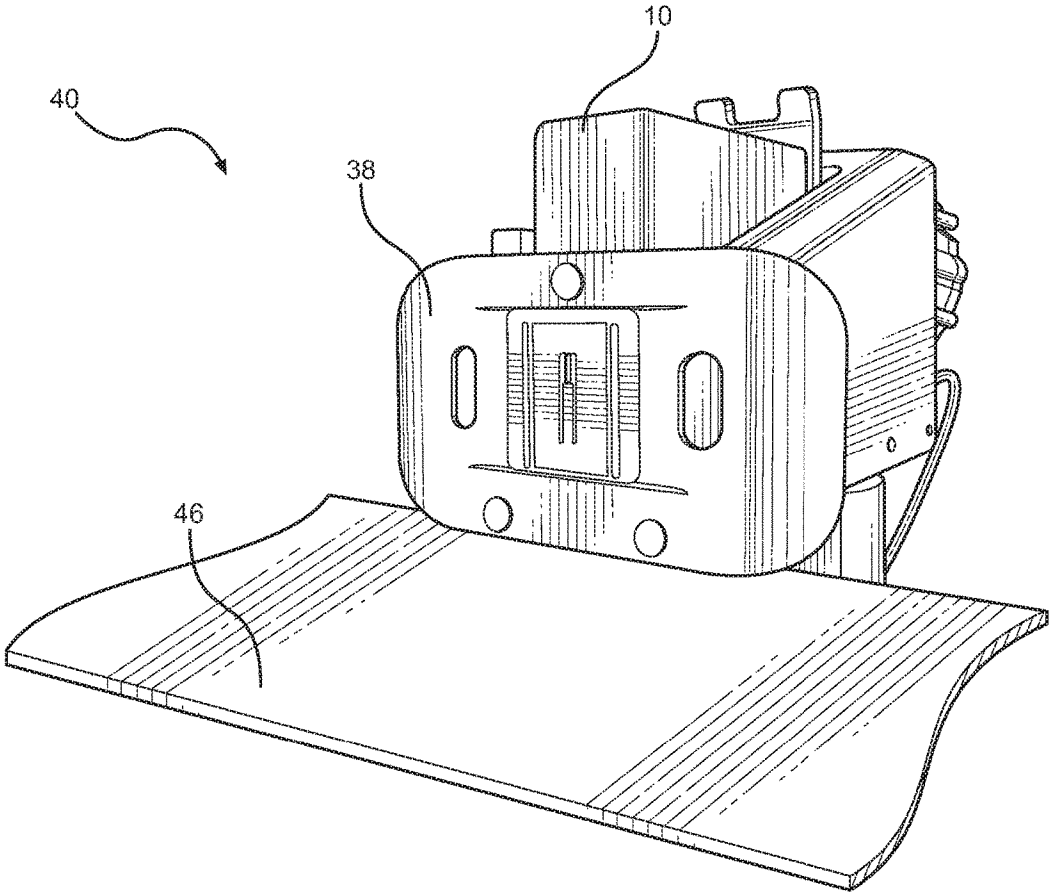
FIGS. 5A & 5B are a perspective view of an inkjet printing system using a fluidic ejection cartridge in accordance with one embodiment of the present disclosure.
Figure 5B:
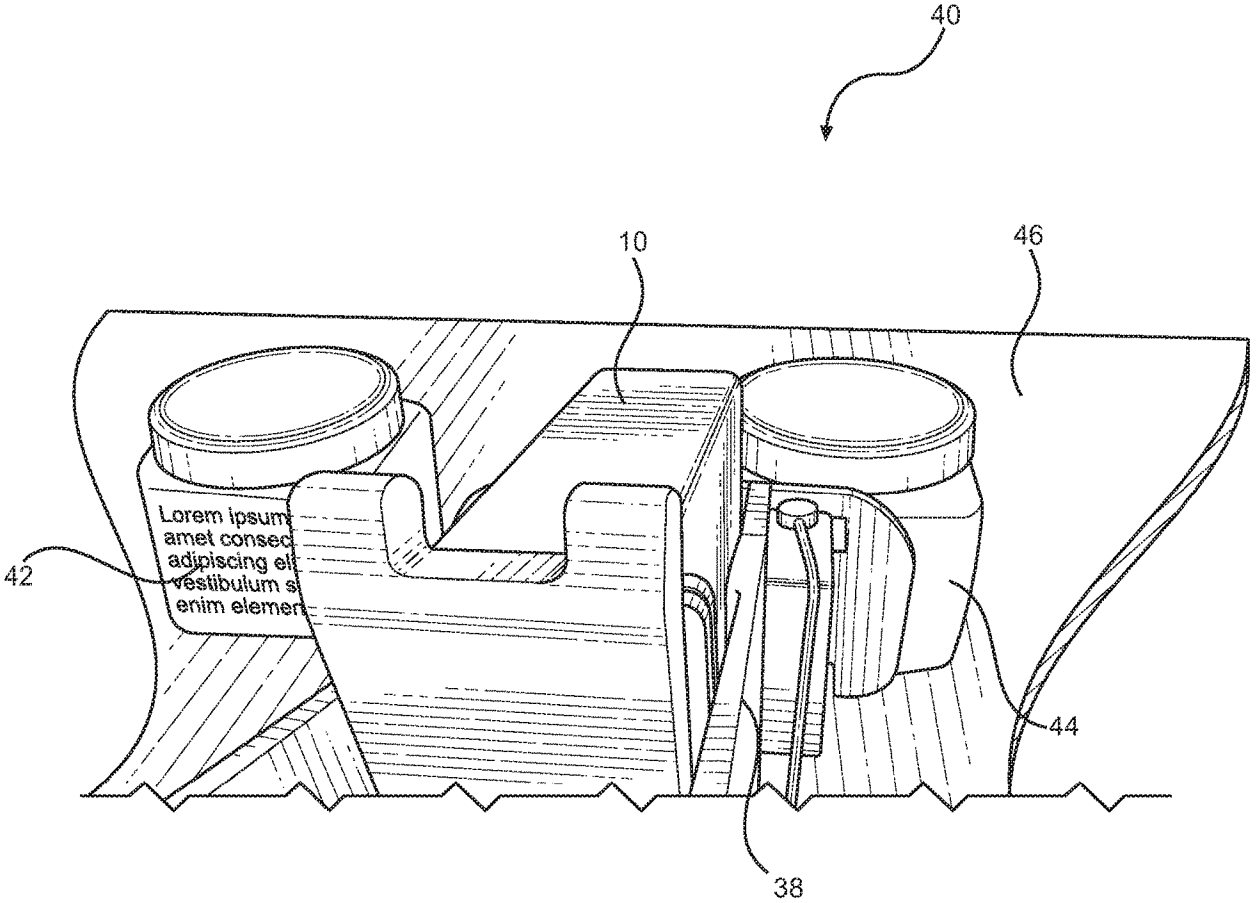

In use, the fluidic ejection cartridge 10 may be installed on a printhead 38 of a drop-on-demand inkjet printing system 40, as shown in FIG. 5A, and then used to print the desired indicia 42 on the non-porous surface of the substrate 44, using the ejectable ink from the thermal or piezoelectric inkjet printing system as shown in FIG. 5B. In some instances, this printhead 38 may be held in a fixed orientation, with only the substrate being moved past the printhead 38 in a controlled manner. For instance, the substrate 44 to be printed may be placed on a moving belt 46 which brings the substrate past the printhead for printing.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A fluidic ejection cartridge comprising:

a cartridge body having an upper portion, a lower portion, at least one sidewall, and a hollow cavity within the cartridge body defining a fluid reservoir;

a cartridge lid disposed over the upper portion of the cartridge body;

a cartridge bottom plate disposed under and sealed to the lower portion of the cartridge body; and a cartridge nosepiece disposed under and sealed to the cartridge bottom plate, the nosepiece having at least one fluidic ejection chip in fluid flow communication with the fluid reservoir, wherein the cartridge body, the cartridge lid, and the cartridge bottom each comprises ceramic, and wherein the cartridge body and cartridge lid are molded together as a unitary ceramic piece.

2. The cartridge of claim 1, wherein the cartridge body, the cartridge lid, and the cartridge bottom each comprises soda-lime glass.

3. The cartridge of claim 1, wherein the cartridge body, the cartridge lid, and the cartridge bottom each comprises borosilicate glass.

4. The cartridge of claim 1, wherein the cartridge nosepiece and the cartridge bottom plate are molded together as a unitary ceramic piece.

5. The cartridge of claim 1, further comprising a fluid filter element disposed between the fluid reservoir and the fluidic ejection chip.

6. The cartridge of claim 1, further comprising a volume of an ejectable fluid disposed within the fluid reservoir.

7. The cartridge of claim 6, wherein the ejectable fluid comprises at least one organic solvent selected from the group consisting of alcohols, acetates, ketones, hydrocarbon solvents, halogenated solvents, and lactones, rather than an aqueous-based solvent.

8. The cartridge of claim 6, wherein the ejectable fluid comprises at least one organic solvent selected from the group consisting of methanol, ethanol, isopropanol, butanol, 1-methoyx-2-propanol, 2-butoxyethanol, ethyl acetate, butyl acetate, acetone, methyl ethyl ketone, methyl isobutyl ketone, benzene, toluene, xylene, hexane, petroleum, chloroform, diodomethane, N-ethyl-2-pyrrolidone, N-methylpyrrolidone, and -butyrolactone, rather than an aqueous-based solvent.

9. The cartridge of claim 6, wherein the ejectable fluid is a printing ink and further comprises a pigment or dye.

10. A method for printing on a non-porous substrate, the method comprising the steps of:

providing a substrate having a printable, non-porous surface;

providing a drop-on-demand inkjet printing system including an inkjet cartridge, the inkjet cartridge comprising:

a cartridge body having an upper portion, a lower portion, at least one sidewall, and a hollow cavity within the cartridge body defining a fluid reservoir;

a cartridge lid disposed over the upper portion of the cartridge body;

a cartridge bottom plate disposed under and sealed to the lower portion of the cartridge body, wherein the cartridge body, the cartridge lid, and the cartridge bottom each comprises ceramic, and wherein the cartridge body and cartridge lid are molded together as a unitary ceramic piece;

a cartridge nosepiece disposed under and sealed to the cartridge bottom plate, the nosepiece having at least one fluidic ejection chip in fluid flow communication with the fluid reservoir; and a volume of an ejectable ink disposed within the fluid reservoir, wherein the ink comprises a pigment or dye and at least one organic solvent selected from the group consisting of alcohols, acetates, ketones, oils, hydrocarbon solvents, halogenated solvents, and lactones, rather than an aqueous-based solvent; and printing desired indicia on the non-porous surface of the substrate, using the ejectable ink from the drop-on-demand inkjet printing system.

11. The method for printing of claim 10, wherein the substrate comprises a material selected from the group consisting of plastics, metals, glass, and plastic-coated paper.

12. The method for printing of claim 10, wherein the cartridge body, the cartridge lid, and the cartridge bottom each comprises soda-lime glass.

13. The method for printing of claim 10, wherein the cartridge body, the cartridge lid, and the cartridge bottom each comprises borosilicate glass.

14. The method for printing of claim 10, wherein the cartridge noisepiece and the cartridge bottom plate are molded together as a unitary ceramic piece.

15. The method for printing of claim 10, wherein the ejectable ink comprises at least one organic solvent selected from the group consisting of methanol, ethanol, isopropanol, butanol, 1-methoyx-2-propanol, 2-butoxyethanol, ethyl acetate, butyl acetate, acetone, methyl ethyl ketone, methyl isobutyl ketone, benzene, toluene, xylene, hexane, petroleum, chloroform, diodomethane, N-ethyl-2-pyrrolidone, N-methyl-pyrrolidone, and -butyrolactone, rather than an aqueous-based solvent.

16. The method for printing of claim 10, wherein the inkjet cartridge further comprises a fluid filter element disposed between the fluid reservoir and the fluidic ejection chip.

* * * * *